United States Patent [19]

Baehr

[11] 3,987,600

[45] Oct. 26, 1976

[54] FIRE RESISTANT DOORS

[75] Inventor: Donald O. Baehr, Arlington Heights, Ill.

[73] Assignee: United States Gypsum Company, Chicago, Ill.

[22] Filed: Dec. 10, 1975

[21] Appl. No.: 639,496

[52] U.S. Cl. ..... 52/615; 49/503; 52/232; 428/920

[51] Int. Cl.[2] ..... E04C 2/00; E04C 2/34; E04B 2/28

[58] Field of Search ..... 52/232, 615–620, 52/404; 49/501, 503; 106/110; 156/39, 42, 71; 428/920, 921; 264/285

[56] References Cited

UNITED STATES PATENTS

| | | | |
|---|---|---|---|
| 3,185,297 | 5/1965 | Rutledge | 52/232 X |
| 3,225,505 | 12/1965 | Lytz | 52/615 |
| 3,299,595 | 1/1967 | Munk | 52/618 X |
| 3,311,516 | 3/1967 | Jaunarajs et al. | 156/71 |
| 3,864,201 | 2/1975 | Susuki | 428/920 X |

FOREIGN PATENTS OR APPLICATIONS

| | | | |
|---|---|---|---|
| 728,984 | 4/1955 | United Kingdom | 49/503 |
| 490,163 | 8/1938 | United Kingdom | 49/503 |

*Primary Examiner*—J. Karl Bell

*Attorney, Agent, or Firm*—Kenneth E. Roberts; Robert H. Robinson; Samuel Kurlandsky

[57] ABSTRACT

Fire-resisting doors having a novel framing, that is the stiles and rails of the door, are disclosed. The door comprises preferably a thermal insulating core and conventional outer facing cover sheets and is framed with a particular combination of glass fibers and gypsum in a particular arrangement.

10 Claims, 3 Drawing Figures

FIRE RESISTANT DOORS

BACKGROUND OF THE INVENTION

1. Field of the Invention

The present invention relates to fire-resisting constructions, and more particularly refers to a fire door structure having improved means provided for framing a fire-resistant core and facing skins.

2. Description of the Prior Art

For years the various building codes have accepted a one and three-quarter inch thick solid core wood door, or a solid wood core door, as an appropriate method of protecting an opening between a room and a corridor. Such doors performed acceptably in many fires where they provided necessary protection between a room and a corridor in an individual house, a hotel guest room and a corridor, an apartment house dwelling unit and a corridor, hospital or nursing home patient rooms and a corridor, and so on. However, in the last twenty years or so, the increasing awareness of both a need for and the provision of increasingly more fire resistant measures and also the increasing scarcity and cost of acceptable wooden door cores, and the necessary labor and skill to solidly build them and provide effective fire barriers, has lead to an increased strictness of building codes. With modern high-rise construction becoming more prevalent, it has become even more necessary today than ever before to use fire doors of that type which will exhibit good fire-resistance so that they will pass the requisite fire tests and will withstand the conditions to which they are subjected during ordinary day-to-day usage and during intense fires in such buildings. Responsive to these needs, there has been considerable development of various door core materials as the insulation buffer between the outer skins and considerable development in the techniques of constructing fire doors with such newer core materials. There have even been some changes in the outer skins or facings of the doors. However during all this time the choices for suitable stiles and rails to form the framing of such doors have remained at only wood, sometimes impregnated with a fire retarding salt chemical, and metal.

Wood, of course remains the standard framing material of fire door construction. But it is the weakest link to contain a fire, especially with increased duration or intensity, or both, of the fire. In standard fire tests ordinary wood framing burns out in about one half an hour; and while chemically impregnated wood lasts longer it still fails in less than an hour. The problem is not only the smoldering and then igniting of the wood but also the ensuing structural failure. If the wood around the hinges or latch burns away, then the door may fall. Also the merely burning away of an area creates sufficient opening for the passage of smoke and eventually the passage of the fire itself around the door barrier. Currently tests for fire ratings subject doors to a fire to test for both burning and smoke passage and then apply a fire hose stream of water to test for structural integrity. Generally wooden framed doors burn through and collapse in just over a half hour and generally less than one hour even when impregnated with a fire retardant chemical salt during the fire portion of the test.

Metal rails and stiles suffer certain disadvantages also. Firstly various metals are quite heat conductive; and when the metal facing skin on one side of the door is exposed to the heat of a fire it readily transmits its heat to the metal framing members, and they quickly transmit the heat onto the opposite side of the door and its facing skin. Increasingly, building codes are recognizing that the heat build-up on the side of the door away from a fire can cause ignition to nearby objects such as curtains, draperies and other room furnishings etc. In addition, as the temperature of most metals rises, the metal expands and this expansion causes a warping, twisting and distortion. When metal framed fire doors begin to warp, with the intense heat of high temperature fire tests and increased duration of the fire test, the entire door structure bends allowing openings to occur and thus allowing the passage of smoke and flame. This causes the door to fail the fire test.

Another material which has been used to a great extent in the construction of panels for non-structural uses has been gypsum or plaster and it has been proposed to adhere metal facing sheets to such panels. For example U.S. Pat No. 3,866,376 provides a demountable wall assembly of a metal clad gypsum panel in a hollow wall assembly. Such an arrangement is in no way suggested for, or contemplates, a fire door assembly as disclosed herein. Also, the advantage of combining gypsum with small amounts of fibrous materials such as glass fibers to extract some of the good properties of each was early recognized; for example, see U.S. Pat. No. 1,719,726 issued on July 2, 1929 to Raynes which disclosed a gypsum wallboard, one or more of the edges of the body of which are provided with a strip of fibrous material which might for example be impregnated with gypsum. In that instance, the board was provided with a loose fibrous material i.e. short chopped fibers in dispersed random arrangement to increase the resistance of the edges to chipping and cracking during handling, shipping or the like. Such short random fibers provided only a capacity to absorb surface shock of the fragile material, while most if not all of the tensile strength of the panel was provided by the gypsum material and very little if any bending strength or ductility was provided to the panel. U.S. Pat. No. 3,616,173 is to much the same effect, as is U.S. Pat. No. 2,744,022. Further, U.S. Pat. No. 3,311,516 also relates to gypsum sheets for building constructions but utilizing large quantities of a very fine and small asbestos fiber to form their sheets so such would be without appreciable bending strength; and U.S. Pat. Nos. 2,892,339 and 3,106,503 teach the making of honey comb structural panels with inter-connected gypsum "cells." While such products are widely utilized as finishing materials in the covering of room walls, corridors, shaft walls, demountable partitions and the like, they do not possess sufficient strength, particularly bending strength to serve as the framing member of structural panels and doors. This material is not particularly resistant to bending forces such as those created when doors are repeatedly subjected to the types of stress normally applied to them. That is, upon repeated openings and closings, along with intermittent slamming to which a door is subjected in ordinary usage, and particularly where it is a thick generally much heavier door, the material is just too brittle to withstand the constant impact and would shatter and break in usage without being subjected to a fire. In addition in the area of door construction there is a current trend toward finding inexpensive doors meeting a minimum fire rating. That is doors which will consistently and inexpensively meet a 20 minute fire rating. Here either the cores or facing sheets are not very critical on fire resistance but the framework in addition to fire resistance must possess sufficient bending strength if a material substitution for wood or metal is to be found.

SUMMARY OF THE INVENTION

It is accordingly a principal object and advantage of this invention to provide an improved construction of a fire resisting door the frame of which does not practically distort under the action of heat as do conventional metallic rails and stiles and the frame of which does not readily burn through under the action of heat as do conventional wooden rails and stiles.

A further object and advantage of the present invention is to combine glass or other mineral fiber in an inorganic cementitious binder to form the rails and stiles of a fire resistant door frame having improved properties.

The invention is a fire-resistant, composite door which comprises a hereinafter more particularly described frame of rails and stiles; a core of suitable thermal insulating material contained within such frame; and facing sheets of preferably a non-combustible material covering the frame and door core. The covering facing sheets may be conventional metallic layers, such as sheet steel or sheet aluminum, or incombustible and fire resistant inorganic cementitious materials such as gypsum panels and the like for longer duration fire ratings or even wood veneers for shorter duration fire ratings. The core materials may be conventional solid, foam or honey-combed construction and the like, comprising for example magnesium oxychloride foam cement, expanded polyurethane, mineral wool mats or gypsum or hardboard honeycomb or egg-crate construction or boards of asbestos bound with cement. The improvement in the framing members comprises the rails and stiles being composed of a gypsum matrix surrounding alternate layers of (a) a plurality of continuous glass fiber rovings running parallel to the length of the stiles and rails, with alternating layers of (b) a woven or non-woven glass fiber mat.

It was not believed that providing an inorganic cementitious material such as gypsum as a matrix reinforced with mineral fibers such as glass fiber could provide a structure of sufficient resiliency and bending strength as to be suitable for use in a fire door frame. It was generally assumed that such materials could not stand up to repeated ordinary day-to-day usage sufficient to serve as a door frame but rather they would crack and break after the first few closings of the door. Surprisingly it has now been found that a particular combination of two different types of a mineral fiber reinforcement to an inorganic cementitious matrix will provide the necessary tensile strength as well as more surprisingly, the necessary bending strength to be suitable for the intended use as a fire door frame. In the present invention, it is not merely providing a mineral fiber reinforcement per se which allows meeting the objectives and advantages but it is the alternating layers and layering of continuous rovings parallel to the length of the stile or rail in combination with the alternate layering of a mat, whether woven or non-woven, of a mineral fiber which provides these properties in the inorganic cementitious matrix. In the ensuing discussion reference will be made to "glass" fiber and "mineral" fiber. It will be understood that such is by way of illustration and is to be understood as including any ceramic fiber material of a non-metallic mineral nature such as graphite fibers, other carbon fibers, alumina combined with silica fibers and the like fibers.

BRIEF DESCRIPTION OF THE DRAWINGS

The above and additional objects and advantages of the present invention will become apparent from the following description thereof, taken in conjunction with the following drawings, wherein.

DETAILED DESCRIPTION OF THE PREFERRED EMBODIMENTS

Figure 1:
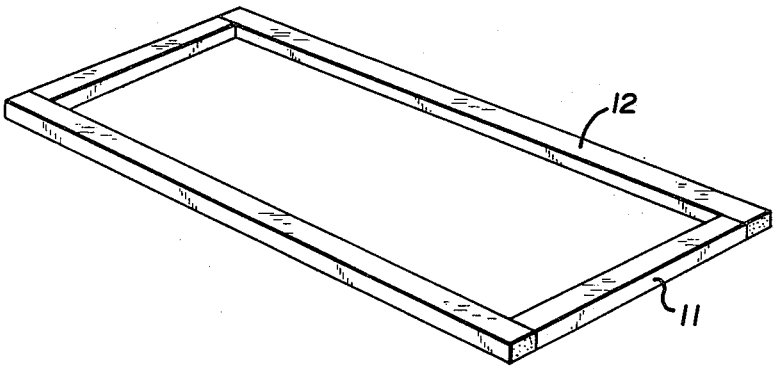
FIG. 1 is a perspective view of a frame comprising stiles and rails according to the invention.
Figure 2:
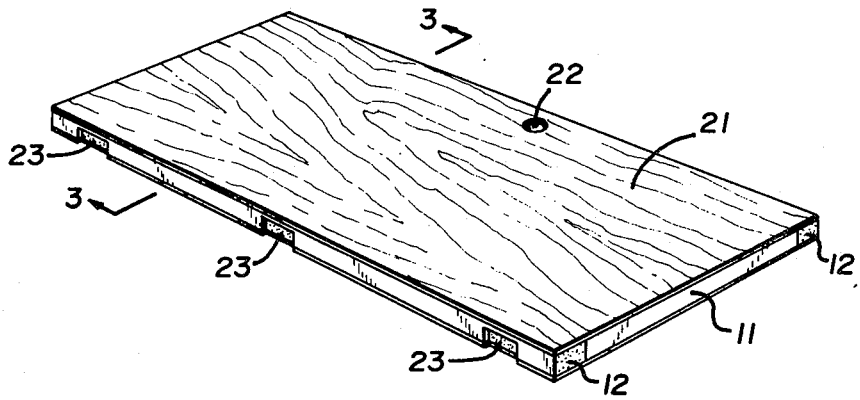
FIG. 2 is a perspective view of a fire door structure according to the invention having the frame of FIG. 1 therein.

Referring now to FIGS. 1 and 2 of the drawings an embodiment of the composite fire door panel of the present invention is shown which comprises rails 11 and stiles 12 of the invention forming the frame for a suitable fire-resistant core material (not shown) and covered by facing skins 21. It is the novel construction of the rails 11 and stiles 12 which provides the necessary both tensile strength and bending strength which obtains the objects and advantages of the present invention.

As more particularly shown in FIG. 1, the rails 11 and stiles 12 are secured in abutting arrangement and may be secured by any suitable means such as being adhesively secured; provided with metal fasteners; wood dowling; dovetail joints and the like. The precise composition of the particular core materials (not shown) is not critical to the invention. Preferably they will generally comprise materials which will provide an insulating fire resistance when exposed to fire or to elevated temperatures. As such, the core material may be a substantially solid unitary sheet, batt or slab of material such as mineral wool or other refractory or ceramic mineral or glass fibers. Further the core may comprise monolithic sheets or separate blocks combined together of such other common fire door core materials as foamed cementitious materials such as expanded polyurethane; magnesium oxychloride foam cements; basically siliceous containing cements; and the like or may be of an open egg-crate or honey-comb construction for weight purposes. The core for minimum duration fire door purposes may even be of cardboard or other compressed cellulosic materials of open configuration such as eggcrate. All such core materials and configurations thereof shall be referred to herein as "thermally insulating material." The core may be secured to the rails 11 and stiles 12 by any suitable means such as adhesive wooden or metal fasteners; or dovetail joints and e like.

Figure 3:
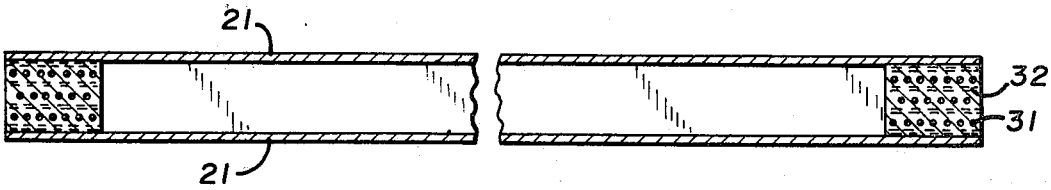
FIG. 3 is a fragmentary cross-sectional view of the structure shown in FIG. 2.

Referring to FIGS. 2 and 3, the facing sheets 21 comprises a substantially solid monolithic sheet, preferably of fire resistant material. The exact composition of the sheet used as the facing sheets 21 of the present invention is not critical. In fact such sheet may be a thin wood veneer of minimum fire duration fire doors that would be allowed to burn off during a fire since the resistant core and frame would still remain. More preferably the facing sheet is of a fire resistant material. For example, a suitable composite fire door of the invention may use a metallic sheet for facing sheets 21. In other embodiments the facing sheet 21 may comprise various inorganic cementitious sheets; and in one preferred embodiment facing sheets 21 may comprise a thin sheet of a high strength gypsum matrix reinforced by suitable glass or refractory ceramic fibers. Thus in one preferred alternative embodiment the facing sheets may be composed of about ⅛ inch thick glass reinforced gypsum sheets manufactured by combining about 6% by volume of one inch long chopped glass fibers with a low water demand gypsum slurry cast to form an appropriately sized sheet. In an alternative highly preferred embodiment the facing sheets 21 will be composed of thin sheet metal skins.

Heretofore it has not been thought possible to utilize cast gypsum bars in the framing of door members because such materials would not provide sufficient bending strength. By bending strength is meant beam strength or those racking stresses normally applied to bars, panels or sheets when repeatedly subjected to a twisting or bending motion. Wooden stiles and rails, the standard of the industry, will have an allowable unit stress in bending on the order of about 1800 p.s.i. and are quite elastic while in contrast thereto straight gypsum bars will provide an ultimate bending stress on the order of about 1000 p.s.i. or less and are very brittle. Even reinforcing such bars with large quantities of woven or non-woven glass fiber matting provides only about 3000 p.s.i. ultimate bending stress. It has now been surprisingly found that providing alternating layering of continuous glass strand reinforcement and woven or non-woven glass mat reinforcement provides very high tensile strength and surprisingly strong bending stress on the order of 5000 and 6000 p.s.i. The improvement in the fire door frame provided by the present invention, more particularly illustrated in FIG. 3 of the drawings is that the rails 11 and stiles 12 are composed of a gypsum matrix surrounding alternating layers of (a) a plurality of continuous ceramic fiber rovings running parallel to the length of the stiles and rails with alternating layers of (b) a woven or non-woven mat 32 of ceramic fibers. The ceramic fibers of the rovings 31 and mat 32 may be of any suitable temperature resisting inorganic fiber materials and thus may be of ordinary glass fiber composition or more refractory fiber composition. The particular composition of the glass fiber material is not critical to the present invention; but what is important is the alternating layering of rovings and mat. This particular combination provides the superior composite possessing substantial resistance to shear forces in the plane of the stiles and rails and while possessing substantial resistance to bending and twisting forces in the plane of the stiles and rails, as might be experienced in a door construction subjected to ordinary day-to-day usage of repeated openings and closings, slamming and jarring etc. The gypsum matrix surrounding the rovings 31 and mat 32 may in generally be provided of any gypsum or plaster slurry. However in preferred embodiments it is desired to utilize a "low consistency" or lower water demand plaster material in providing the gypsum matrix since such will ordinarily provide a water demand or consistency in the range of about 30–50. Further, as additional embodiments the gypsum matrix may be supplemented in amounts of from about 5 to about 80% or more by weight of Portland cements. However, to provide compatibility, when Portland cements are included in the gypsum matrix formulation one should use a alkali resistant glass material for the rovings 31 and mat 32.

This invention is illustrated by the following example.

EXAMPLE

A door having a total thickness of about 1¾ inches and standard height and width was constructed as a lightweight minimum corridor fire door. Such doors are generally of solid wood framing with cardboard egg-crate configuration cores and thin metallic facing skins to achieve anywhere from 20 minutes towards a one hour fire rating. Such doors may also be of solid wood cores 1¾ inches thick with thin wood facing sheets for a 20 minute fire test exposure; but if there are any large knot holes or voids in the wood core or frame the only fire barrier left is that provided by the two thin facings which can burn through in only three or four minutes.

The door here used rails 11 and stiles 12 as shown in FIG. 3, manufactured by casting bars in a mold sized 1⅝ inch × 1¼ inch × 92 inch using a gypsum slurry having a low consistency (25 cc of water per 100 grams of plaster). In the casting, a layer of the gypsum slurry was poured into the mold and then a glass fiber non-woven or random mat piece 8 foot long and 1½ inch wide (¾ ounce per square foot) was placed in the mold and tamped into the slurry. A second layer of the gypsum slurry was poured onto the mat and tamped to penetrate between the fibers of the mat. Then about a half dozen continuous rovings of glass fiber (nominal filament diameter 0.00043 inch and 200–400 filaments per strand with about 60 strands per roving) cut longer than the mold were placed into the mold with the length of the rovings running parallel to the length of the bar. Another layer of gypsum slurry was poured over them and tamped to compact the gypsum matrix around the glass fiber strands, or rovings. The alternate layering of gypsum matrix, non-woven glass mat, gypsum matrix, glass rovings was repeated until the desired dimensions were obtained; and then the bars were allowed to set and then cut to size. As shown more particularly in FIG. 2, cut-outs for hinge mountings 23 and for door latch mechanism 22 were provided by cutting away the particular section after the cast bars had cured. This may also be provided by build-up portions of the mold configuration and then casting around the built up portions. The cast bars contained a total of about 5% of glass fiber, both mat and rovings, on a dry cast weight basis in a gypsum matrix and had a dry modulus of rupture in bending of about 6000 p.s.i.

The stiles and rails were then secured by butt gluing with an epoxy adhesive and single one inch × ¼ inch wood dowels for convenience; and a cardboard egg-crate core was merely loosely set within the door frame. One side of the door was covered with 24 gauge steel facing sheet and the other side was covered with a gypsum sheet reinforced with about 6% of short chopped pieces (about 1 inch long) of glass fiber; and the door was attached to a thin aluminum tracking and hinging with plastic snap trim on a plasterboard corridor barrier.

The door was then placed in a fire test apparatus and subjected to standard fire of 45 minutes and hose of water testing of 12 seconds. The door frame held the 45 minutes of fire and was one second short of holding the 40 p.s.i. hose stream test when the facings delaminated from the stile and rail due to the epoxy adhesive. Examination and evaluation of the rails and stiles following the test showed them to be virtually undamaged, with substantially original tensile and bending strengths, intact without any chipping, shattering or cracking, and merely blackened in color by smoke and flame. Had a more suitable adhesive or mechanical fastening means been used it is believed the framework would easily have passed the hose test. Of course for longer endurance fire rating tests the core would use more appropriate materials such as mineral fiber panels; metal sheathing on both sides; and more secure fastening means i.e. larger wooden doweling or metal doweling, fire resistant adhesives or metal fasteners etc.

It is to be understood that the invention is not to be limited to the exact details of operation or structure shown and described in the specification and drawings, since obvious modifications and equivalents will be readily apparent to one skilled in the art. For example the gypsum matrix can be augmented with i.e. Portland cements in various amounts to augment strengths of the matrix but such may require the use of alkali resistant glass depending on the amount of Portland cement. Further the stiles and rails may be manufactured by other means common to the art such as by an extruding operation rather than a casting operation.

What is claimed is:

1. A fire resisting door comprising a framework of stiles and rails, a core of thermally insulating material within the framework, and at least one outer facing sheet covering the core and framework; the improvement comprising said stiles and rails of said framework containing a gypsum matrix reinforced with layers of (a) a plurality of continuous glass fiber rovings set parallel to the length of the framework, and (b) alternating spaced apart layerings of glass fiber mat.

2. A fire resisting door according to claim 1, wherein said mat is a non-woven mat.

3. A fire resisting door according to claim 1, wherein said mat is a woven mat.

4. A fire resisting door according to claim 1, wherein said gypsum is a low consistency gypsum.

5. A fire resisting door according to claim 1, wherein said gypsum is alpha gypsum.

6. A fire resisting door according to claim 1, wherein said facing sheet is composed of metal.

7. A framework for holding a door core and at least one outer facing sheet, said framework comprising stiles and rails containing a gypsum matrix reinforced with layers of (a) a plurality of continuous glass fiber rovings set parallel to the length of the stiles and rails and (b) alternating spaced apart layerings of glass fiber mat.

8. A framework according to claim 7, wherein said gypsum is a low consistency gypsum.

9. A framework according to claim 7, wherein said gypsum is alpha gypsum.

10. A framework according to claim 7, wherein said rovings and said mat are of inorganic fiber.

* * * * *